US006359952B1

(12) United States Patent
Alvord

(10) Patent No.: US 6,359,952 B1
(45) Date of Patent: Mar. 19, 2002

(54) TARGET GRID ASSEMBLY

(75) Inventor: C. William Alvord, Knoxville, TN (US)

(73) Assignee: CTI, Inc., Knoxville, TN (US)

( * ) Notice: Subject to any disclaimer, the term of this patent is extended or adjusted under 35 U.S.C. 154(b) by 0 days.

(21) Appl. No.: 09/511,818

(22) Filed: Feb. 24, 2000

(51) Int. Cl.[7] ..... G21K 5/08

(52) U.S. Cl. ..... 376/202; 250/442.1; 376/190; 376/195; 376/196; 376/197; 376/198; 376/199; 376/200; 376/201; 376/203; 376/204

(58) Field of Search ..... 376/190, 195, 376/196, 197, 198, 199, 200, 201, 202, 203, 204; 250/442.1

(56) References Cited

U.S. PATENT DOCUMENTS

| | | | | | |
|---|---|---|---|---|---|
| 4,752,432 | A | * | 6/1988 | Bida et al. | 376/195 |
| 4,800,060 | A | * | 1/1989 | Goldring | 276/202 |
| 5,586,153 | A | * | 12/1996 | Alvord | 376/196 |
| 5,608,224 | A | * | 3/1997 | Alvord | 250/442.11 |
| 5,665,971 | A | * | 9/1997 | Chen et al. | 250/385.1 |
| 5,917,874 | A | * | 6/1999 | Schlyer et al. | 376/194 |

* cited by examiner

*Primary Examiner*—Michael J. Carone
*Assistant Examiner*—John Richardson
(74) *Attorney, Agent, or Firm*—Pitts & Brittian, P.C.

(57) ABSTRACT

A target grid assembly for employment in a target assembly used to produce radioisotopes by bombarding a target material contained in the target assembly with a particle beam. The target assembly includes the target grid assembly, the target window and a target body enclosed in a target housing. The target body defines a target reservoir for receiving the target material and the target window serves to seal the target reservoir.

The target grid assembly includes a vacuum window and a target grid. The target grid defines a target grid portion, a helium input and a helium output. The target grid portion defines a plurality of target grid supports which are configured to form a plurality of target grid oblong openings. The vacuum window is supported against the upstream side of the target grid portion and the target window is supported between the downstream side and the target body. A helium space is defined by the plurality of target grid oblong openings between the target window and the vacuum window and is configured such that helium is injectable into the helium space via the helium input and extractable from the helium space via the helium output to form a helium cooling regime.

4 Claims, 4 Drawing Sheets

TARGET GRID ASSEMBLY

TECHNICAL FIELD

This invention relates to the field of target grid assemblies for use with accelerators for the production of radioisotopes.

BACKGROUND ART

Positron Emission Tomography (PET) is a powerful tool for diagnosing and treatment planning of many diseases wherein radioisotopes are injected into a patient to diagnose and assess the disease. Accelerators are used to produce the radioisotopes used in PET. Generally, an accelerator produces radioisotopes by accelerating a particle beam and bombarding a target material, housed in a target system, with the particle beam.

Several factors must be considered when developing a target system for the production of radioisotopes. In the case of gas or liquid targets, the target material must be maintained at an elevated pressure during bombardment to compensate for the effects of density reduction of the target material due to heating/expansion/phase change (boiling). Further, it is desirable to operate at higher beam currents to increase production of the radioisotopes. Because of the amount of heat generated during bombardment, cooling the target material and other components of the target system is of significant importance.

A typical target system includes a target window sealed against a target cavity with the target material retained in the target cavity. The target window is necessarily thin to minimize energy loss to heat generated in the target window. The design constraint of making the target window as thin as possible is balanced by the need to maintain the target material at an elevated pressure during bombardment, as stated above. Because the target window must support higher pressures, a lower limit is placed on the thickness of the target window to maintain a given pressure on the target side. Moreover, the desirability of operating with higher beam currents and increased beam size also conflicts with the minimization of the thickness of the target window. More specifically, one simple way to accomplish increased beam production is to increase the physical size of the beam which necessitates making the target window larger, but the maximum pressure sustainable by a window decreases linearly with window area. Conventional target system designs at present have maximized the available technology with regard to window thickness, selection of window materials and overall target performance such that operating at higher pressures and increased beam sizes is not possible with these conventional target systems.

Target systems developed more recently include the use of a thick high transparency grid to support the target window. The grid breaks the window into several smaller windows of significantly smaller area, thereby increasing the maximum pressure the target window material can withstand such that, with windows of the same material and thickness as currently used, the bean size can increase, as well as the target operating pressure. However, there are additional design constraints introduced by the grid. Specifically, the grid must be thick enough in the beam propagation direction to mechanically support the target window. In many cases, the thickness of the grid is thicker than the distance the beam travels in typical grid candidate materials. Therefore, any beam that is intercepted by the grid does not reach the target material to produce the desired radioisotope. For this reason, the grid transparency must be maximized, primarily by reducing the thickness of the grid septa (webs or supports).

The best strength/transparency geometry is hexagonal grid cells, a configuration which is well known in the art and has been applied to numerous target system designs and illustrated in FIGS. 1*a* and 1*b*. A drawback to the hexagonal grid is the difficulty involved with manufacturing the grid.

Utilizing a grid to support the target window introduces additional complications with respect to cooling. Regardless of the target design, heat is generated in the target material during the bombardment process. This heat is conducted to and through the target window. When utilizing a grid, the impinging beam heats the grid which in turn conducts heat to the target window and the target material. It has been shown that, if the grid is cooled at its edges by recirculating water or other coolants, the heat from the intercepted beam onto the grid, the heat deposited in the target window and some of the heat from the target material can be removed by the grid. However, only modest amounts of heat is removed from the target material with this method of cooling. Moreover, even with a conventional, non-gridded target window wherein the window is helium cooled, the heat removed from the target material is modest compared with the heat generated in the target material. To incorporate the helium cooling of the conventional target design into the hexagonal grid support design, the grid would have to be mechanically very complex to produce jets that impinge on each sub-window. Moreover, when keeping the septa small (on the order of 0.010" thick), it would be impossible to achieve impinging helium jets for each sub-window.

It has been shown that the highest temperature and therefore, the most density-reduction prone region of the target material is very near the target window. Therefore, to increase yields and length of service intervals and to improve reliability, significant effort should be dedicated to better cooling of the target window.

Therefore, it is an object of this invention to provide a target grid assembly which defines a configuration such that helium cooling to cool the target window and target material can be employed.

It is another object of the present invention to provide a target grid assembly which can remove more heat from the target material than the target grid assemblies of the prior art.

Further, it is an object of the present invention to provide a target grid assembly which can withstand higher pressures and higher beam currents than the non-gridded assemblies of the prior art.

Moreover, it is another object of the present invention to provide a target grid assembly wherein the thickness of the grid septa or supports is minimized.

It is yet another object of the present invention to provide a target grid assembly which includes a grid which defines a simpler design and is easier to manufacture than the hexagonal grid of the prior art, while being capable of providing support to the target window similar to that of the hexagonal grid.

DISCLOSURE OF THE INVENTION

Other objects and advantages will be accomplished by the present invention which serves to provide a target grid assembly for employment in a target assembly used to produce radioisotopes by bombarding a target material contained in the target assembly with a particle beam. The target assembly includes the target grid assembly, a target window and a target body enclosed in a target housing. The target body defines a target reservoir for retaining the target material and the target window is positioned against the target body to cover and seal the target reservoir.

The target grid assembly includes at least a target grid which serves to support the target window. The target grid defines a target grid portion defining a plurality of target grid supports which are configured to form a plural of target grid oblong openings. In the preferred embodiment, the target grid assembly further includes a vacuum window and the target grid further defines a helium input and a helium output. The vacuum window is positioned against the upstream side of the target grid portion and the target window and target body are positioned on the downstream side of the target grid. A helium space is defined by the plurality of target grid oblong openings between the target window and the vacuum window and is configured such that helium is injectable into the helium space via the helium input and extractable from the helium space via the helium output to form a helium cooling regime.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1A:
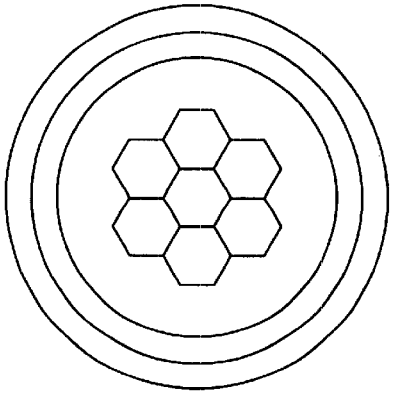
Fig.1a (PRIOR ART)
FIG. 1*a* is an end view of a grid of the prior art.

A target grid assembly incorporating various features of the present invention is illustrated generally at 10 in the figures. The target grid assembly 10 includes a target grid for use with a conventional target assembly. The target grid defines a simpler grid design and is easier to manufacture than the hexagonal grid of the prior art, while being capable of providing support to a target window similar to that of the hexagonal grid. In the preferred embodiment, the target grid assembly 10 is designed to include a means for helium cooling the target window and target material such that the target assembly in which the target grid assembly is employed can remove more heat and operate under higher pressure and higher beam currents than the target systems of the prior art.

The target grid assembly 10 of the present invention includes at least a target grid 16. The target grid 16 defines a target grid portion 20 which is linear in design, as shown most clearly in the exploded view of FIG. 3*b*. More specifically, the target grid portion 20 defines a plurality of grid supports 22 or septa which are configured to form a plurality of oblong openings 24. The grid supports 22 are minimized in thickness to increase the transparency of the grid portion 20 and more specifically, the grid support thickness is on the order of 0.010" thick. The target grid 16 also defines at least one fluid cooling channel around its periphery (not shown).

The target assembly 60 in which the target grid assembly 10 is employed is conventional and includes a target window 63, a target body 64 and a target housing. The target body 64 defines a reservoir 65 for receiving target material 66 therein The target window 63 is positioned against the target body 64 to seal the target reservoir 65, and the target housing (not shown) serves to enclose the target grid assembly 10, the target window 63 and the target body 64 therein. The target window 63 is supported by the downstream side 54 of the grid supports 22 of the target grid 16, as shown most clearly in the schematic diagram of FIG. 2. The target grid portion 20 serves to divide the target window 63 into several smaller subwindows With the use of a target grid 16 to support the target window 63, the target window 63 can be fabricated from materials which lack tensile strength but provide other benefits. For example, copper beryllium provides high thermal conductivity but lacks tensile strength. The target grid 16 eliminates the drawbacks with respect to the target window's lack of strength.

Figure 1B:
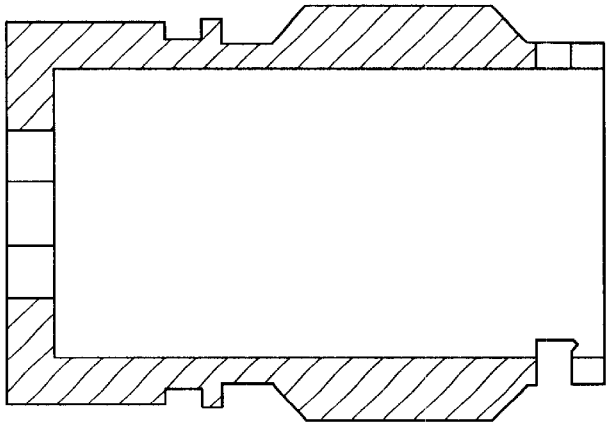
Fig.1b (PRIOR ART)
FIG. 1*b* is a side view, in section, of the grid of FIG. 1*a;*

It will be noted that the oblong geometry of the openings 24 of the target grid portion 20 of the present invention does not support the target window 63 as effectively as the hexagonal geometry of the prior art target grid, shown in FIGS. 1*a* and 1*b* for the same characteristic dimensions. The characteristic size (width) of the oblong openings 24 or linear grid must be scaled accordingly to maintain the window strength of a hexagonal geometry.

In the preferred embodiment, the target grid assembly 10 further includes a vacuum window 12. The vacuum window 12 is positioned on the upstream side 56 of the target grid supports 22, as shown most clearly in FIG. 2. The target grid 16 further defines a helium input 26 and a helium output 28, shown most clearly in FIG. 3*a*.

Figure 2:
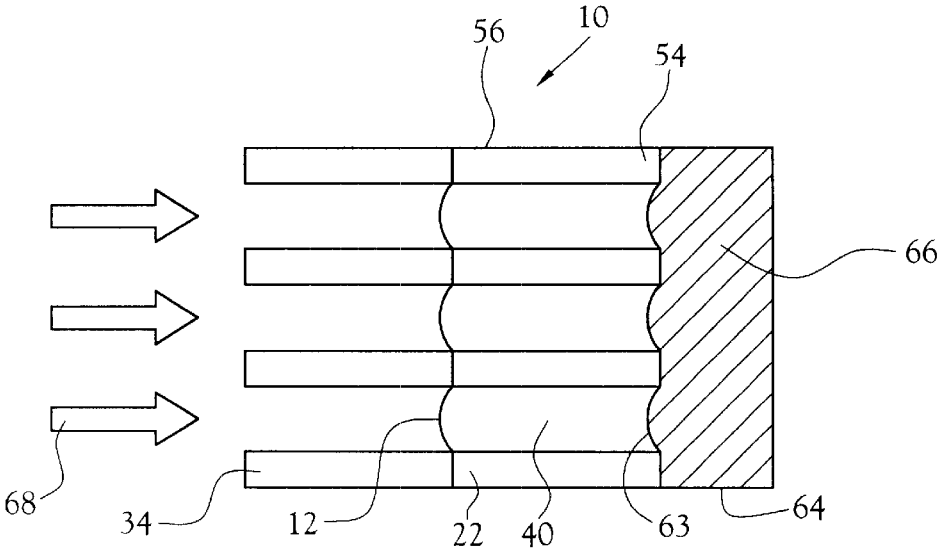
FIG. 2 is a schematic diagram of a process depicting various features of a target system utilizing the target grid assembly of the present invention being bombarded with a particle beam.

It is desirable to establish a good contact between the vacuum window 12 and the face of the target grid supports 22. Moreover, it is desirable to increase the operating pressure of the helium recirculating system. For these reasons, it is preferable to employ an interception grid 32 to support the vacuum window 12. The interception grid 30 defines an interception grid portion 32 which defines a plurality of grid supports 34 or septa. The grid supports 34 are configured to form a plurality of oblong openings 36 similar in configuration to the oblong openings 24 defined by the target grid portion 20, as shown in FIGS. 2–4. The vacuum window 12 is positioned between the interception grid supports 34 and the target grid supports 22, as shown most clearly in FIG. 2. It will be noted that it is preferable that the interception gird supports 34 and the target grid supports 22 are aligned. In the preferred embodiment, the interception grid 30 further defines at least one fluid cooling channel on its periphery (not shown).

A helium space 40 is defined between the vacuum window 12 and the target window 63. More specifically, the area defined by the target grid oblong openings 24 and enclosed between the vacuum window 12 and the target window 63 serves as the helium space 40.

Figure 3A:
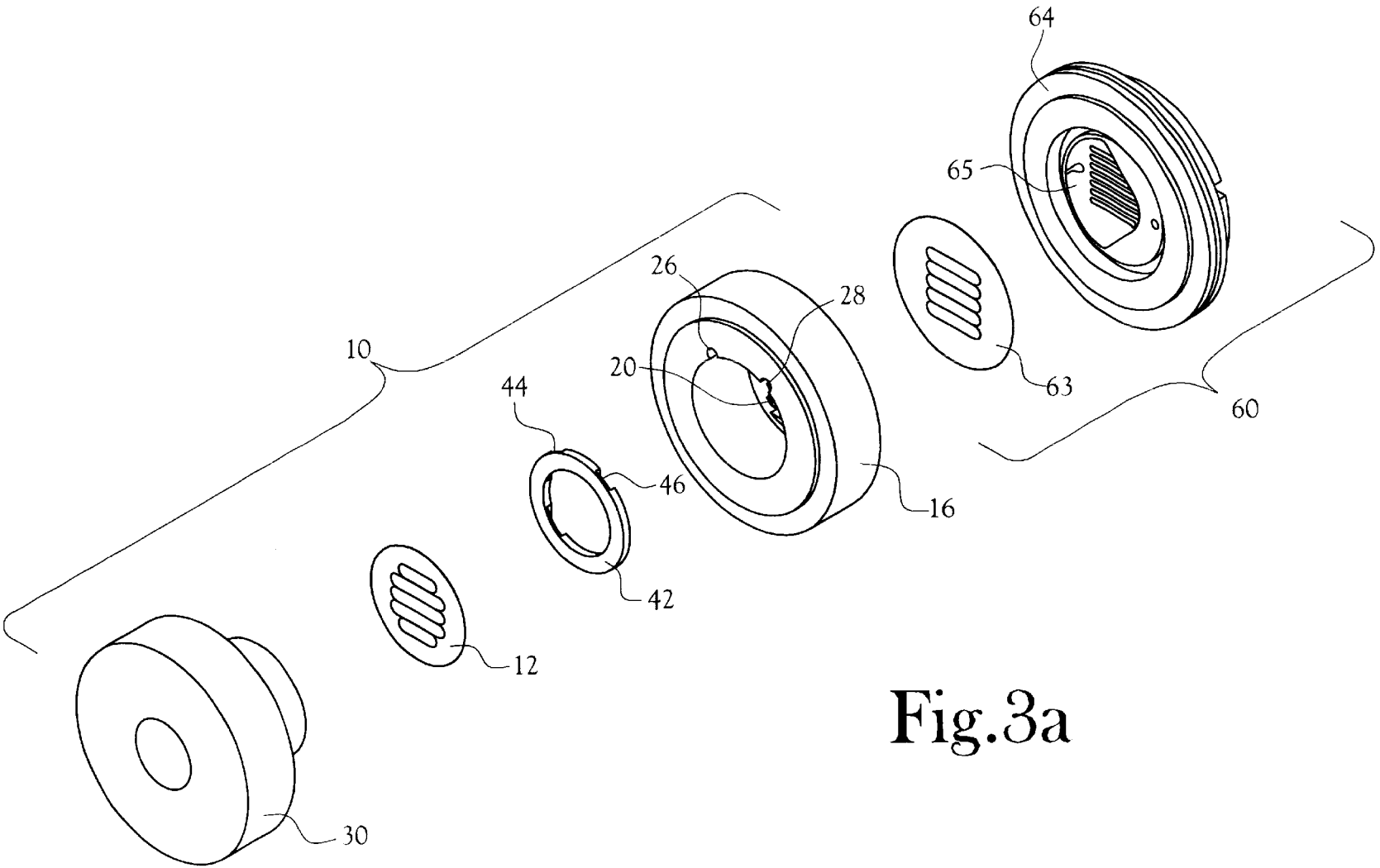
FIG. 3*a* is an exploded view of a target system illustrating the target grid assembly of the present invention.
Figure 3B:
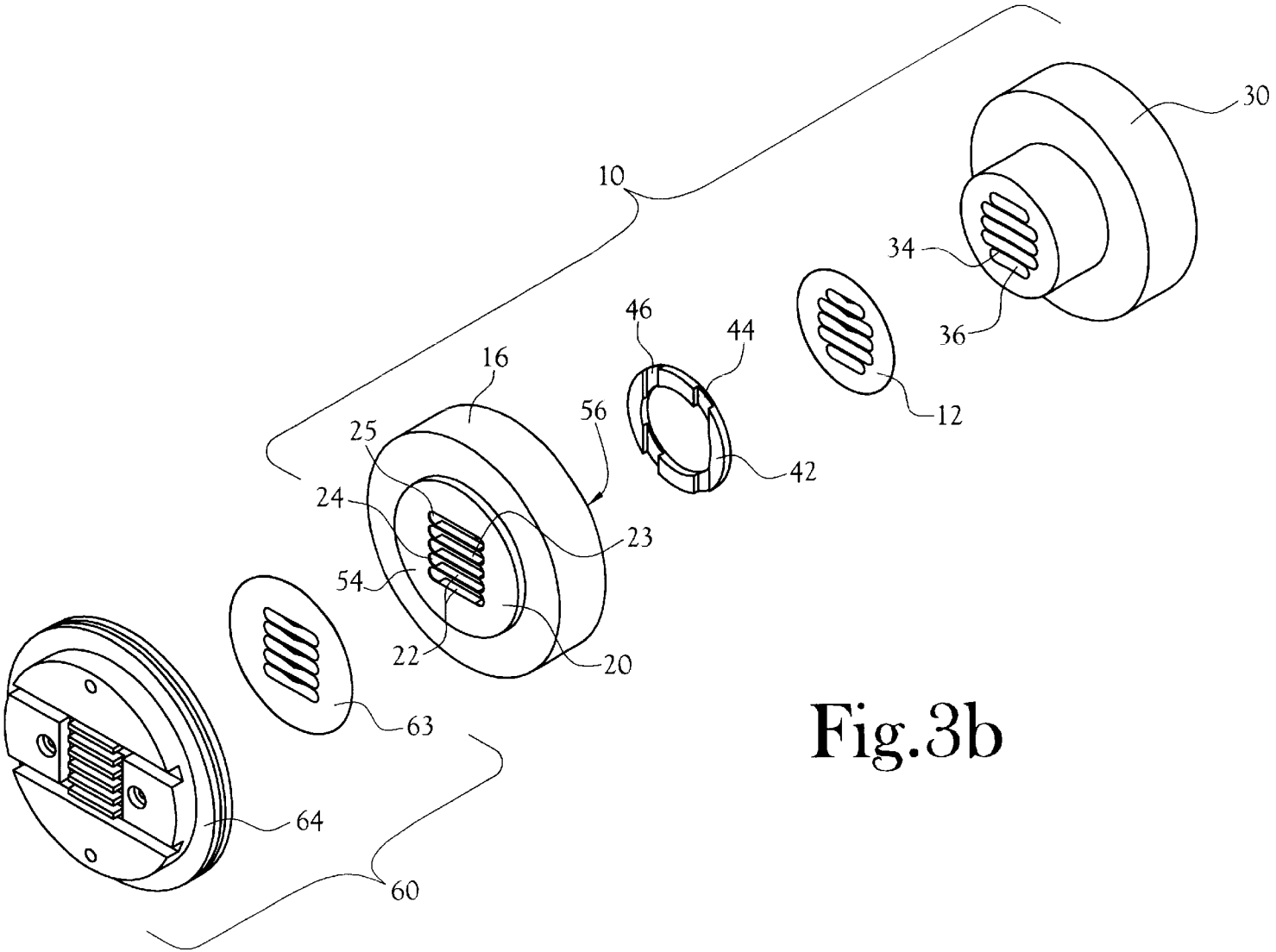
FIG. 3*b* is an exploded view of the target system of FIG. 3*a* illustrating an opposing view; and, FIG. 4 is a side view, in section, of a target system including the target grid assembly of the present invention.
Figure 4:
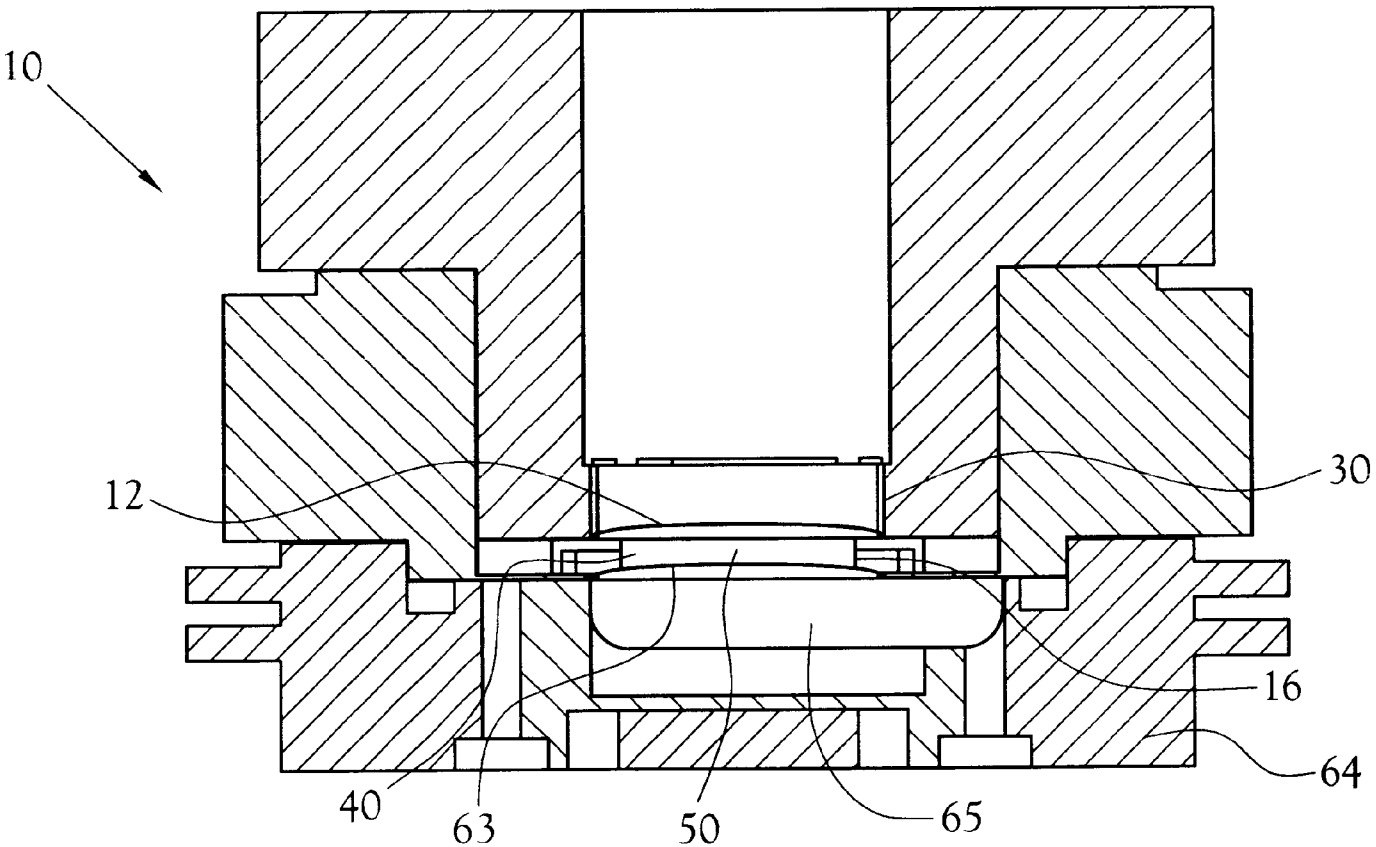

Referring to the exploded views of FIGS. 3*a* and 3*b*, a slotted O-ring 42 is positioned between the target grid 16 and the vacuum window 12. More specifically, the O-ring 42 defines two spaced apart slots 44, 46. These slots 44, 46 are spaced to coincide with helium input 26 and the helium output 28, respectively, of the target grid 16 and run perpendicular to the upper portion 23 and lower portion 25, respectively, of the oblong openings 24 defined by the target grid portion 20.

FIG. 2 illustrates a schematic diagram of a particle beam 68 striking the preferred embodiment of the target grid assembly 10 to ultimately bombard the target material retained in the target body 64 of a target assembly 60. The interception grid supports 34 intercept a portion of the incoming beam 68 thereby causing the supports 34 to heat up. This heat is removed by the cooling water or fluid circulating through the fluid cooling channels (not shown). Because the interception grid supports 34 are not in contact with the target window 63, the heat absorbed therein does not contribute to the heat in the target window 63 and target material 66. More specifically, without the interception grid 30, the target grid supports 22 would absorb heat from the incoming particle beam 68 which would contribute to the heat in the target window 63 and target material 66. It will be noted that heat absorbed in the target grid 16 is removed by fluid cooling channels (not shown) around the target grid periphery. The remainder of the beam 68 passes through the vacuum window 12 and target window 63 to bombard the target material 66 retained in the target body reservoir 65.

As the target material 66 is bombarded, it heats up and this heat is conducted to the target window 63. Cooling the target window 63 with helium will serve to cool the target window 63 and the target material 66. Further, the vacuum window 12 will be cooled. In the prior art, a high velocity helium jet is utilize to cool target windows. In the present invention, a helium cooling regime 50 is established. This helium cooling regime 50 is high density and therefore, high mass flow and high heat capacity. This high density regime 50 is more effective at heat removal than the helium jet of the prior art. However, the vacuum window 12 must be able to tolerate the higher pressure of the helium cooling regime 50. It is an added benefit of the preferred embodiment of the present invention that the interception grid 30 upstream of the vacuum window 12 provides precisely the necessary support for such a scenario. In FIG. 2, it will be noted that the vacuum window 12 and target window 63 are bowed out between each of their respective grid supports 34, 22. The high pressure in the target reservoir 65 bows the target window 63 and the high pressure of the helium cooling regime bows the vacuum window 12.

Helium flows into and out of the helium space 40 via the helium input 26 and the helium output 28 of the target grid 16, respectively. The vacuum window 12 and target window 63 serve as upper and lower boundaries of the helium cooling regime 50. Helium flows into the upper portion 23 of each oblong opening 24 via the first slot 44 defined by the O-ring 42 and exits the lower portion 25 of each oblong opening 24 via the second slot 46 of the O-ring 42. The close contact established between the vacuum window 12 and the target grid supports 22 via the interception grid supports 34 serves to minimize cross flow of helium from one oblong opening 24 to another such that the helium cooling regime 50 can be established and maintained.

From the foregoing description, it will be recognized by those skilled in the art that a target grid assembly offering advantages over the prior art has been provided. Specifically, the target grid assembly includes a grid which defines a configuration such that helium cooling to cool the target window and target material can be employed, while being capable of providing support to the target window similar to that of the hexagonal grid of the prior art. Further, the linear target grid assembly can remove more heat for the front (upstream) of the target than gridded window systems of the prior art. Further, the grid defines a simpler grid design which is easier to manufacture than the hexagonal grid of the prior art. Further, the target grid assembly can withstand higher pressures and higher beam currents than the non-gridded assemblies of the prior art. Moreover, the thickness of the grid septa or supports is minimized for transparency.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A target grid assembly for employment in a target assembly used to produce radioisotopes by bombarding a target material contained in the target assembly with a particle beam, the target assembly further including a target body defining a target reservoir for receiving the target material and a target window for sealing the target reservoir, said target grid assembly comprising:

a vacuum window;

a target grid defining a target grid portion, a helium input and a helium output, said target grid portion defining a plurality of target grid supports which are configured to form a plurality of target grid oblong openings, said target grid portion defining an upstream side and a downstream side, said vacuum window being positioned against said upstream side, the target window being supported between said downstream side and the target body, a helium space being defined by said plurality of target grid oblong openings between said vacuum window and the target window and being configured such that helium is injectable into said helium space via said helium input and extractable from said helium space via said helium output; and an interception grid positioned upstream of said vacuum window, said interception grid defining an interception grid portion which defines a plurality of interception grid supports, said interception grid supports being configured to form a plurality of interception grid oblong openings, said vacuum window being positioned between said interception grid supports and said target grid supports.

2. The target grid assembly of claim 1 further including a slotted O-ring defining a first slot and a second slot, said first slot being spaced apart from said second slot such that said first slot coincides with said helium input and said second slot coincides with said helium output, said first slot extending perpendicular to an upper portion of each of said plurality of target grid oblong openings and said second slot extending perpendicular to a lower portion of each of said plurality of target grid oblong openings such that helium injected into said helium input flows into said upper portion of each of said plurality of target grid oblong openings thereby filling said helium space and flows out of said lower portion of each of said plurality of target grid oblong openings into said second slot and through said helium output thereby establishing a helium cooling regime.

3. The target grid assembly of claim 1 wherein said interception grid supports and said target grid supports are aligned.

4. A target grid assembly for employment in a target assembly used to produce radioisotopes by bombarding a target material contained in the target assembly with a particle beam, the target assembly further including a target body defining a target reservoir for receiving the target material and a target window for sealing the target reservoir, said target grid assembly comprising:

a vacuum window; and, a target grid defining a target grid portion, a helium input and a helium output, said target grid portion defining a plurality of target grid supports which are configured to form a plurality of target grid oblong openings, said target grid portion defining an upstream side and a downstream side, said vacuum window being positioned against said upstream side and the target window being supported between said downstream side and the target body, a helium space being defined by said plurality of target grid oblong openings between said vacuum window and the target window;

a slotted O-ring defining a first slot and a second slot, said first slot being spaced apart from said second slot such that said first slot coincides with said helium input and said second slot coincides with said helium output, said first slot extending perpendicular to an upper portion of each of said plurality of target grid oblong openings and said second slot extending perpendicular to a lower portion of each of said plurality of target grid oblong openings such that helium injected into said helium input flows into said upper portion of each of said plurality of target grid oblong openings thereby filling said helium space and flows out of said lower portion of each of said plurality of target grid oblong openings into said second slot and through said helium output thereby establishing a helium cooling regime; and, an interception grid positioned upstream of said vacuum window, said interception grid defining an interception grid portion which defines a plurality of interception grid supports, said interception grid supports being configured to form a plurality of interception grid oblong openings, said vacuum window being positioned between said interception grid supports and said target grid supports, said interception grid supports and said target grid supports being aligned.

* * * * *